US008836636B2

(12) United States Patent
Maeda

(10) Patent No.: US 8,836,636 B2
(45) Date of Patent: Sep. 16, 2014

(54) DRIVING METHOD OF ELECTROPHORETIC DISPLAY DEVICE, ELECTROPHORETIC DISPLAY DEVICE, AND ELECTRONIC APPARATUS

(75) Inventor: Hiroshi Maeda, Suwa (JP)

(73) Assignee: Seiko Epson Corporation (JP)

( * ) Notice: Subject to any disclaimer, the term of this patent is extended or adjusted under 35 U.S.C. 154(b) by 1117 days.

(21) Appl. No.: 12/331,852

(22) Filed: Dec. 10, 2008

(65) Prior Publication Data

US 2009/0189884 A1 Jul. 30, 2009

(30) Foreign Application Priority Data

Jan. 28, 2008 (JP) ..... 2008-016170

(51) Int. Cl.
*G09G 3/34* (2006.01)

(52) U.S. Cl.
CPC ..... *G09G 3/344* (2013.01); *G09G 2310/04* (2013.01); *G09G 2300/0857* (2013.01); *G09G 2330/021* (2013.01)
USPC ..... 345/107; 345/98; 345/204; 345/100; 345/55; 345/90; 345/30; 349/33; 349/19; 349/41; 349/143; 359/295; 359/296

(58) Field of Classification Search
CPC ..... G09G 3/34
USPC ..... 345/214, 89, 100, 77, 107, 98, 204, 55, 345/90, 30; 348/77; 359/296, 295; 349/33, 349/19, 41, 143
See application file for complete search history.

(56) References Cited

U.S. PATENT DOCUMENTS

| | | | | |
|---|---|---|---|---|
| 2003/0048370 | A1* | 3/2003 | Koyama | 348/311 |
| 2003/0151582 | A1* | 8/2003 | Ishii | 345/100 |
| 2008/0238867 | A1 | 10/2008 | Maeda et al. | |

FOREIGN PATENT DOCUMENTS

| | | |
|---|---|---|
| JP | 2003-084314 | 3/2003 |
| JP | 2006-215293 | 8/2006 |
| JP | 2007-087666 | 3/2007 |

* cited by examiner

*Primary Examiner* — Olga Merkoulova
(74) *Attorney, Agent, or Firm* — Harness, Dickey & Pierce, P.L.C.

(57) ABSTRACT

An electrophoretic display device has a display unit including electrophoretic particles that are interposed between a pair of substrates; each pixel including a pixel electrode and a memory circuit, and a switch circuit connected between the pixel electrode and the memory circuit; and first and second control lines connected to the switch circuits. When a ratio of black color pixel data in image data is 50% or more of the image data, the following three-step image display driving action is performed: an image signal input step in which the pixel data is input as an image signal to the memory circuit; a first image display step in which all the pixels are set to black color; and a second image display step in which a white color portion is displayed by inputting a potential to one control line and electrically disconnecting the other control line.

8 Claims, 15 Drawing Sheets

DRIVING METHOD OF ELECTROPHORETIC DISPLAY DEVICE, ELECTROPHORETIC DISPLAY DEVICE, AND ELECTRONIC APPARATUS

BACKGROUND

1. Technical Field

The present invention relates to a driving method of an electrophoretic display device, an electrophoretic display device, and an electronic apparatus.

2. Related Art

An active matrix electrophoretic display device is known which includes a switching transistor and a memory circuit in each pixel (see JP-A-2003-84314). The display device described in JP-A-2003-84314 has a configuration in which micro capsules having charged particles therein are attached onto a substrate in which the switching transistors or pixel electrodes are formed. An image is displayed by controlling the charged particles by the use of an electric field generated between the pixel electrodes and a common electrode interposing the micro capsules therebetween.

The inventors suggested an electrophoretic display device having a memory circuit and a switching circuit in each pixel in the previous application (see Japanese Patent Application No. 2007-087666). In the electrophoretic display device described in the previous application, it is possible to control display states of the pixels independently of image signals stored in memory circuits by the use of potentials input to first and second control lines connected to switch circuits.

However, in the electrophoretic display device described in the previous application, a leak occurs between the pixels depending on the driving mode, thereby enhancing the power consumption.

FIG. 15 is a diagram illustrating the leak between the pixels in the electrophoretic display device described in the previous application. Two adjacent pixels 40A and 40B arranged in a display area of the electrophoretic display device are shown in FIG. 15. The configurations of the pixels 40A and 40B are equal to that of a pixel 40 described in the later embodiments with reference to FIG. 2 and the details of the elements thereof will be described in the later embodiments.

The suffixes "A", "B", "a", and "b" attached to the elements are used to clearly discriminate the adjacent pixels and the elements thereof.

The pixel 40A (40B) includes a driving TFT 41*a* (41*b*), a latch circuit 70*a* (70*b*), a switch circuit 80*a* (80*b*), and a pixel electrode 35*a* (35*b*). The latch circuit 70*a* (70*b*) is an SRAM (Static Random Access Memory) type latch circuit and the switch circuit 80*a* (80*b*) includes two transmission gates. Electrophoretic elements 32 are disposed on the pixel electrodes 35*a* and 35*b* connected to the switch circuits 80*a* and 80*b*, respectively, with an adhesive layer 33 interposed therebetween and a common electrode 37 is formed on the electrophoretic elements 32.

In FIG. 15, the potential S1 of the first control line 91 is in a high level VH and the potential S2 of the second control line 92 is in a low level VL. The pixel electrode 35*a* of the pixel 40A is supplied with the high level potential VH of the first control line 91 through the first transmission gate TG1*a* of the switch circuit 80*a*. On the other hand, the pixel electrode 35*b* of the pixel 40B is supplied with the low level potential VL of the second control line 92 through the second transmission gate TG2*b* of the switch circuit 80*b*.

In this case, leak current flowing through the adhesive layer 33 attaching the pixel electrodes 25*a* and 35*b* to the electrophoretic elements 32 is generated by a transverse electric field resulting from the potential difference between the adjacent pixel electrodes 35*a* and 35*b*. That is, a leak path LP is formed which extends from the first control line 91 to the second control line 92 through the switch circuit 80*a*, the pixel electrode 35*a*, the adhesive layer 33, the pixel electrode 35*b*, and the switch circuit 80*b*.

Since the leak current is small in the vicinity of one pixel but is generated from the entire adjacent pixels having different display gray scales, the leak current increases as a whole of the display unit, thereby enhancing the power consumption.

SUMMARY

An advantage of some aspects of the invention is that it provides an electrophoretic display device and a driving method thereof, which can display an image while suppressing the leak current between pixels, thereby suppressing the power consumption.

According to an aspect of the invention, there is provided a driving method of an electrophoretic display device having a display unit including a plurality of pixels in which electrophoretic elements including electrophoretic particles are interposed between a pair of substrates, each pixel including a pixel electrode, a pixel switching element, a memory circuit connected between the pixel electrode and the pixel switching element, and a switch circuit connected between the pixel electrode and the memory circuit, and first and second control lines connected to the switch circuits. Here, when a ratio of first-gray-scale pixel data in image data displayed on the display unit is 50% or more of the image data, an image display action is performed which includes: an image signal input period in which the pixel data is input as an image signal to the memory circuit of each pixel; a first image display period in which all the pixels are set to a first gray scale by inputting control signals having the same potential to the first and second control lines; and a second image display period in which a second-gray-scale image is displayed by inputting a potential to one control line of the first and second control lines connected to the pixel electrode of the pixel to which the image signal corresponding to a second gray scale other than the first gray scale is input and electrically disconnecting the other control line.

In the image display action of the driving method, the entire display unit displays the first gray scale in the first image display period and displays the second gray scale pattern in the second image display period. Since the pixel electrodes of all the pixels have the same potential in the first image display period, the leak between pixels does not occur. Since one of the first and second control lines is electrically disconnected to break the leak path in the second image display period, the leak between pixels does not occur. Therefore, according to the configuration, it is possible to display an image based on the image data without causing the leak between pixels.

The image data is analyzed in advance and the image display action is performed when the pixel data of the first gray scale included in the image data is great, thereby reducing the number of pixels (that is, pixels displayed with the second gray scale) driven in both of the first image display period and the second image display period. Accordingly, it is possible to reduce the power consumption for the display operation.

When a ratio of second-gray-scale pixel data in the image data is 50% or more, the image display action may include: the image signal input period; a first image display period in which all the pixels are set to a second gray scale by inputting control signals having the same potential to the first and second control lines; and a second image display period in which the first-gray-scale image is displayed by inputting a potential to one control line of the first and second control lines connected to the pixel electrode of the pixel to which the image signal corresponding to the first gray scale is input and electrically disconnecting the other control line.

That is, when the pixel data of the second gray scale other than the first gray scale is greater, all the pixels are allowed to display the second gray scale in the first image display period and the pixels are allowed to display the first gray scale in the second image display period. By using this driving method, it is possible to perform an appropriate display operation on the basis of the ratio of the pixel data in the image data, thereby further reducing the power consumption.

A period in which all the pixels are set to a gray scale other than the gray scale displayed in the first image display period by inputting control signals having the same potential to the first and second control lines may be provided before the first image display period.

That is, the period for erasing the image on the display unit may be provided before the first image display period. In the configuration, since the entire pixels are allowed to display the gray scale other than the gray scale displayed in the first image display period, it is possible to effectively agitate the electrophoretic particles, thereby obtaining a display image with high quality and without any afterimage.

In the image signal input period, the first and second control lines and an electrode opposed to the pixel electrodes with the electrophoretic elements interposed therebetween may be all electrically disconnected.

According to this driving method, since the electrophoretic elements are not driven in the image signal input period, it is possible to prevent an unintended image from being displayed and to suppress the power consumption of the display unit.

When the first image display period is switched to the second image display period, an operation of electrically disconnecting one control line of the first and second control lines may be performed earlier than an operation of inputting the potential to the other control line.

According to this driving method, since it is possible to satisfactorily prevent the first and second control lines having different potentials from being connected to the pixel electrodes, it is possible to satisfactorily suppress the occurrence of leak between pixels, thereby suppressing the power consumption.

According to another aspect of the invention, there is provided an electrophoretic display device comprising a display unit including a plurality of pixels in which electrophoretic elements including electrophoretic particles are interposed between a pair of substrates, each pixel including a pixel electrode, a pixel switching element, a memory circuit connected between the pixel electrode and the pixel switching element, and a switch circuit connected between the pixel electrode and the memory circuit, and first and second control lines connected to the switch circuits. Here, a control unit controlling the driving of the pixels has an operation mode including a period in which image signals corresponding to the pixel data are input to the pixels, a period in which all the pixels are set to a first gray scale, and a period in which an image having a second gray scale other than the first gray scale is displayed by the display unit, includes a calculation unit calculating ratios of gray scales of the pixel data constituting image data displayed by the display unit, and selects the operation mode when the ratio of the first-gray-scale pixel data in the image data is 50% or more as the calculation result of the calculation unit.

The electrophoretic display device according to the aspect of the invention is an electrophoretic display device having the operation mode for setting the entire display unit to the first gray scale and then allowing the display unit to display the second gray scale pattern. In the operation mode, since the pixel electrodes of all the pixels have the same potential in the period in which the entire display unit is set to the first gray scale, the leak between pixels does not occur. Since one of the first and second control lines are electrically disconnected to break the leak path in the period in which the image of the second gray scale is displayed, the leak between pixels does not occur. Therefore, according to the configuration, it is possible to display an image based on the image data without causing the leak between pixels.

The calculation unit analyzes the image data in advance and selects the operation mode when the pixel data of the first gray scale included in the image data is greater, thereby reducing the number of pixels driven twice in the operation mode. Accordingly, it is possible to reduce the power consumption for the display operation.

The control unit may have along with the operation mode as a first operation mode a second operation mode including a period in which the image signals corresponding to the pixel data are input to the pixels, a period in which all the pixels are set to the second gray scale, and a period in which an image having the first gray scale other than the second gray scale is displayed by the display unit, and may select the second operation mode when the ratio of the second-gray-scale pixel data in the image data is 50% or more as the calculation result of the calculation unit.

According to this configuration, it is possible to perform an appropriate display operation on the basis of the ratio of the pixel data in the image data, thereby providing an electrophoretic display device capable of further reducing the power consumption.

According to another aspect of the invention, there is provided an electronic apparatus having the above-mentioned electrophoretic display device. According to this configuration, it is possible to provide an electronic apparatus having a display unit with low power consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
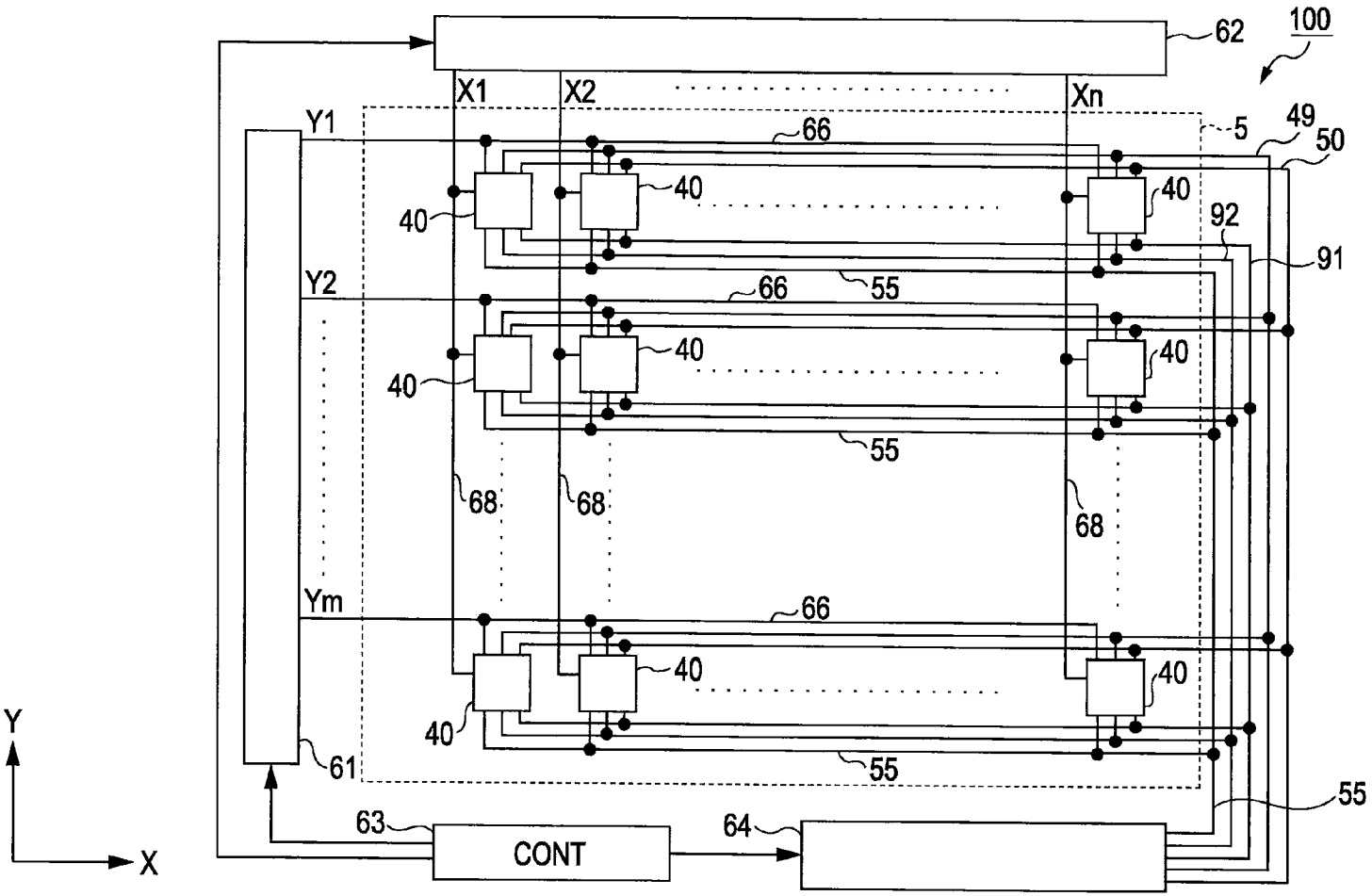
FIG. 1 is a diagram schematically illustrating an electrophoretic display device according to an embodiment of the invention.

Hereinafter, an electrophoretic display device according to an exemplary embodiment of the invention will be described with reference to the accompanying drawings. In this embodiment, an electrophoretic display device employing an active matrix type will be described.

This embodiment represents only an aspect of the invention, but does not limit the invention and may be modified in various forms within the scope of the technical idea of the invention. In the drawings, the scales or the numbers of structures are different from those of actual structures for the purpose of easily understanding the structures.

FIG. 1 is a diagram schematically illustrating a configuration of an electrophoretic display device 100 according to this embodiment.

The electrophoretic display device 100 includes a display unit 5 in which plural pixels 40 are arranged in a matrix. A scanning line driver circuit 61, a data line driver circuit 62, a controller (control unit) 63, and a common source modulation circuit 64 are disposed around the display unit 5. The scanning line driver circuit 61, the data line driver circuit 62, and the common source modulation circuit 64 are connected to the controller 63. The controller 63 generally controls the circuits on the basis of image data or synchronization signals supplied from an upper-level unit.

The display unit 5 includes plural scanning lines 66 extending from the scanning line driver circuit 61 and plural data lines 68 extending from the data line driver circuit 62, and pixels 40 are disposed to correspond to the intersections thereof.

The scanning line driver circuit 61 is connected to the pixels 40 through m scanning lines 66 (Y1, Y2, . . . , and Ym) and serves to sequentially select the first to m-th scanning lines 66 under the control of the controller 63 and to supply a selection signal indicating the ON timing of a driving TFT 41 (see FIG. 2) disposed in each pixel 40 through the selected scanning line 66.

The data line driver circuit 62 is connected to the pixels 40 through n data lines 68 (X1, X2, . . . , and Xn) and supplies image signals indicating 1-bit pixel data corresponding to each pixel 40 to the pixels 40 under the control of the controller 63.

In this embodiment, it is assumed that an image signal of a low level is supplied to the pixels 40 when the pixel data indicates "0" and an image signal of a high level is supplied to the pixels 40 when the pixel data indicates "1".

The display unit 5 is provided with a lower-potential power supply line 49, a high-potential power supply line 50, a common electrode line 55, a first control line 91, and a second control line 92 which all extend from the common power modulation circuit 64 and the lines are connected to the pixels 40. The common power modulation circuit 64 generates various signals to be supplied to the lines and electrically connect and disconnect (change to high impedance) of the lines under the control of the controller 63.

Figure 2:
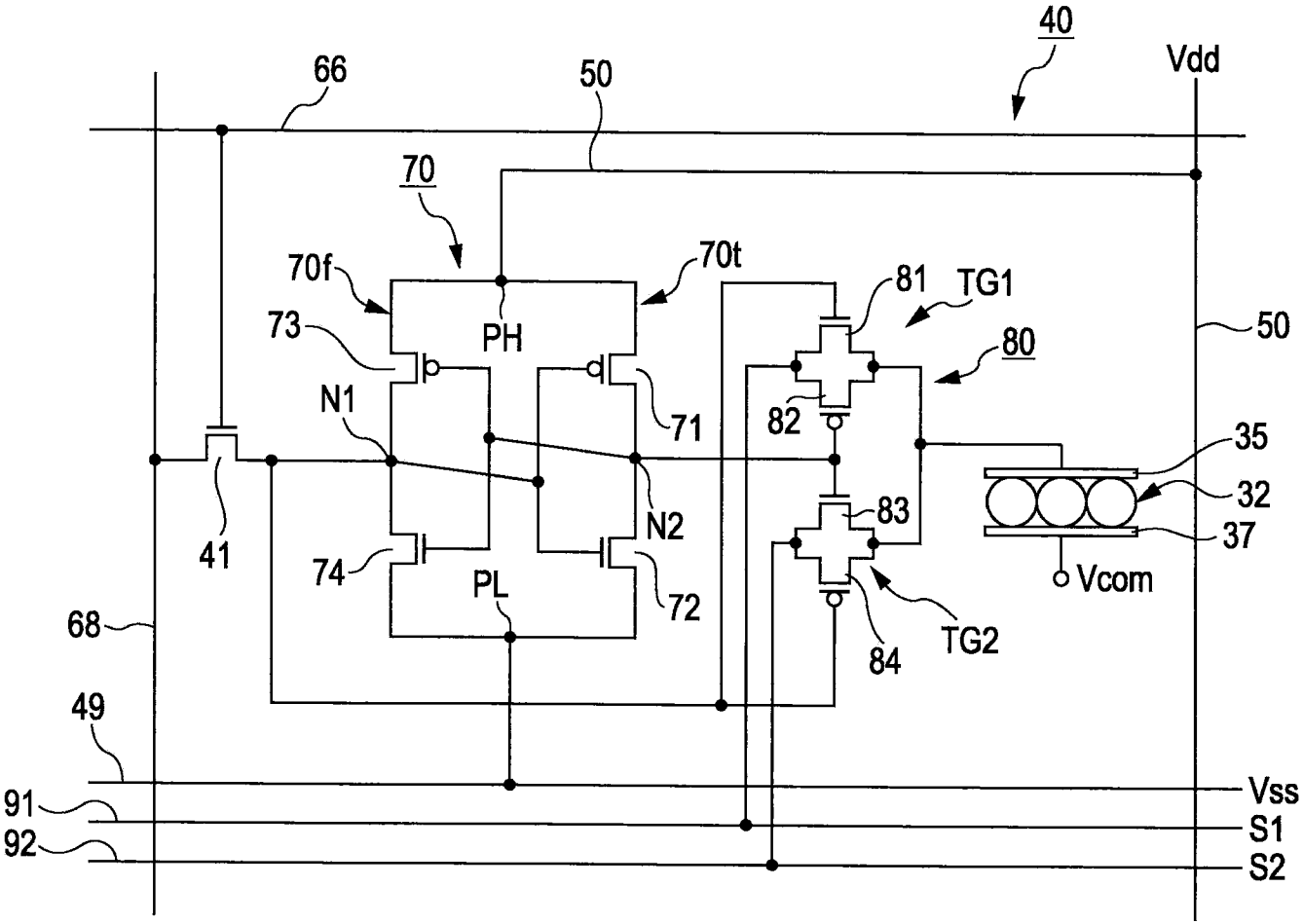
FIG. 2 is a diagram illustrating a configuration of a pixel shown in FIG. 1.

FIG. 2 is a circuit diagram of each pixel 40.

Each pixel 40 includes a driving TFT (Thin Film Transistor) 41 (pixel switching element), a latch circuit (memory circuit) 70, a switch circuit 80, an electrophoretic element 32, a pixel electrode 35, and a common electrode 37. The scanning line 66, the data line 68, the lower-potential power supply line 49, the high-potential power supply line 50, the first control line 91, and the second control line 92 are disposed to surround the elements. The pixel 40 has an SRAM type configuration for storing an image signal as a potential by the use of the latch circuit 70.

The driving TFT 41 is a pixel switching element including an N-MOS (Negative Metal Oxide Semiconductor) transistor. The gate terminal of the driving TFT 41 is connected to the scanning line 66, the source terminal thereof is connected to the data line 68, and the drain terminal is connected to a data input terminal N1 of the latch circuit 70.

The data input terminal N1 and a data output terminal N2 of the latch circuit 70 are connected to the switch circuit 80. The switch circuit 80 is connected to the pixel electrode 35 and is connected to the first and second control lines 91 and 92. The electrophoretic element 32 is interposed between the pixel electrode 35 and the common electrode 37.

The latch circuit 70 includes a transmission inverter 70*t* and a feedback inverter 70*f*. The transmission inverter 70*t* and the feedback inverter 70*f* are both a C-MOS inverter. The transmission inverter 70*t* and the feedback inverter 70*f* form a loop structure in which the input terminal of one is connected to the outer terminal of the other. The inverters are supplied with source voltages from the high-potential power supply line 50 connected thereto through a high-potential power supply terminal PH and the low-potential power supply line 49 connected thereto through a low-potential power supply terminal PL.

The transmission inverter 70*t* includes a P-MOS (Positive Metal Oxide Semiconductor) transistor 71 and an N-MOS transistor 72 of which the drain terminals are connected to the data output terminal N2. The source terminal of the P-MOS transistor 71 is connected to the high-potential power supply terminal PH and the source terminal of the N-MOS transistor 72 is connected to the lower-potential power supply terminal PL. The gate terminals (the input terminal of the transmission inverter 70*t*) of the P-MOS transistor 71 and the N-MOS transistor 72 are connected to the data input terminal N1 (the output terminal of the feedback inverter 70*f*).

The feedback inverter 70*f* includes a P-MOS transistor 73 and an N-MOS transistor 74 of which the drain terminals are connected to the data input terminal N1. The gate terminals (the input terminal of the feedback inverter 70*f*) of the P-MOS transistor 73 and the N-MOS transistor 74 are connected to the data output terminal N2 (the output terminal of the transmission inverter 70*t*).

When an image signal of a high level (H) (pixel data "1") is stored in the latch circuit 70, a signal of the low level (L) is output from the data output terminal N2 of the latch circuit 70. On the other hand, when an image signal of a low level (L) (pixel data "0") is stored in the latch circuit 70, a signal of the high level (H) is output from the data output terminal N2.

The switch circuit 80 includes a first transmission gate TG1 and a second transmission gate TG2.

The first transmission gate TG1 includes an N-MOS transistor 81 and a P-MOS transistor 82. The source terminals of the N-MOS transistor 81 and the P-MOS transistor 82 are connected to the first control line 91 and the drain terminals of the N-MOS transistor 81 and the P-MOS transistor 82 are connected to the pixel electrode 35. The gate terminal of the N-MOS transistor 81 is connected to the data input terminal N1 (the drain terminal of the driving TFT 41) of the latch circuit 70 and the gate terminal of the P-MOS transistor 82 is connected to the data output terminal N2 of the latch circuit 70.

The second transmission gate TG2 includes an N-MOS transistor 83 and a P-MOS transistor 84. The source terminals of the N-MOS transistor 83 and the P-MOS transistor 84 are connected to the second control line 92 and the drain terminals of the N-MOS transistor 83 and the P-MOS transistor 84 are connected to the pixel electrode 35. The gate terminal of the N-MOS transistor 83 is connected to the data output terminal N2 of the latch circuit 70 and the gate terminal of the P-MOS transistor 84 is connected to the data input terminal N1 of the latch circuit 70.

Here, when the image signal of the high level (H) (pixel data "1") is stored in the latch circuit 70 and the signal of the low level (L) is output from the data output terminal N2, the first transmission gate TG1 is turned on and the potential S1 of the first control line 91 is input to the pixel electrode 35. On the other hand, when the image signal of the low level (L) (pixel data "0") is stored in the latch circuit 70 and the signal of the high level (H) is output from the data output terminal N2, the second transmission gate TG2 is turned on and the potential S2 of the second control line 92 is input to the pixel electrode 35.

The pixel electrode 35 is an electrode formed of Al (aluminum) to apply a voltage to the electrophoretic element 32. The common electrode 37 is a transparent electrode formed of MgAg (silver magnesium), ITO (Indium Tin Oxide), or IZO (Indium Zinc Oxide) to apply a voltage to the electrophoretic element 32 along with the pixel electrode 35. A common electrode potential Vcom is supplied to the common electrode 37 through the common electrode line 55. The electrophoretic element 32 displays an image by the use of an electric field resulting from a potential difference between the pixel electrode 35 and the common electrode 37.

Figure 3:
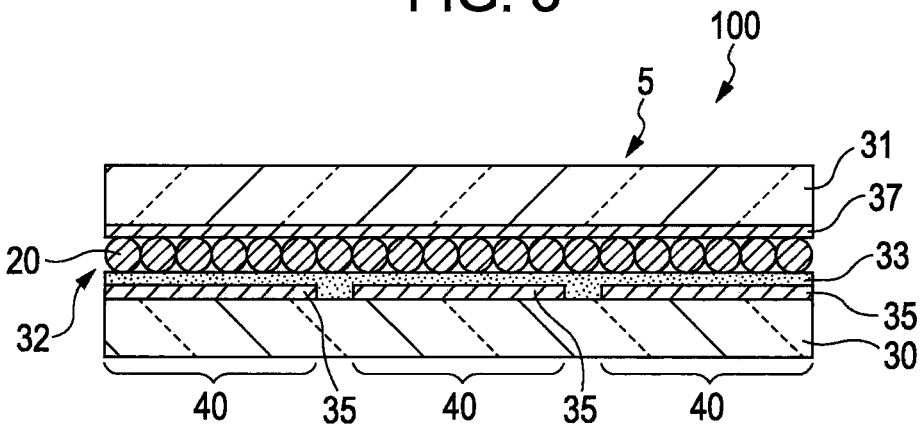
FIG. 3 is a partial section view of the electrophoretic display device according to the embodiment of the invention.

FIG. 3 is a partial sectional view of the electrophoretic display device 100 in the display unit 5. The electrophoretic display device 100 has a configuration in which the electrophoretic elements 32 having plural micro capsules 20 arranged therein are interposed between the element substrate 30 and the counter substrate 31. In the display unit 5, plural pixel electrodes 35 are arranged on the side of the element substrate 30 close to the electrophoretic elements 32 and the electrophoretic elements 32 are bonded to the pixel electrodes 35 with an adhesive layer 33. The common electrode 37 having a plane shape opposed to the plural pixel electrodes 35 is formed on the side of the counter substrate 31 close to the electrophoretic elements 32 and the electrophoretic elements 32 are disposed on the common electrode 37.

The element substrate 30 is a substrate formed of glass or plastic and may not be transparent because it is disposed on the opposite side of an image display surface. Although not shown, the scanning lines 66, the data lines 68, the driving TFTs 41, and the latch circuits 70 shown in FIG. 1 or 2 are formed between the pixel electrodes 35 and the element substrate 30. On the other hand, the counter substrate 31 is a substrate formed of glass or plastic and is transparent because it is disposed on the image display surface side.

The electrophoretic elements 32 are formed in advance on the counter substrate 31 and are generally treated as an electrophoretic sheet including the adhesive layer 33. In the manufacturing process, the electrophoretic sheet is treated in a state where a protective release sheet is bonded to the surface of the adhesive layer 33. The electrophoretic sheet from which the release sheet is removed is bonded to the element substrate 30 (on which the pixel electrodes 35 and various circuits are formed) manufactured independently to form the display unit 5. Accordingly, the adhesive layer 33 exists on only the side close to the pixel electrodes 35.

Figure 4:
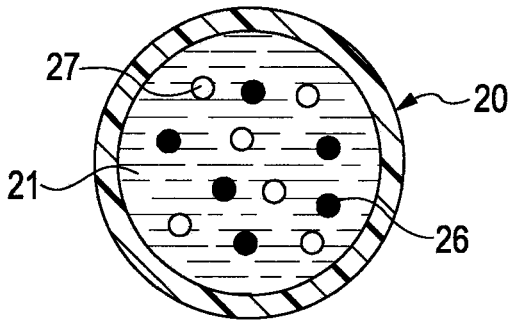
FIG. 4 is a schematic sectional view of a micro capsule.

FIG. 4 is a schematic sectional view of each micro capsule 20. The micro capsule 20 has, for example, a particle diameter of about 50 μm and a spherical member in which a dispersion medium 21, plural white particles (electrophoretic particles) 27, and plural black particles (electrophoretic particles) 26 are enclosed. As shown in FIG. 3, the micro capsule 20 is interposed between the common electrode 37 and the pixel electrode 35 and one or more micro capsules 20 are disposed in one pixel 40.

The outer shell portion (wall membrane) of the micro capsule 20 is formed of transparent polymer resin such as acryl resin such as polymethyl methacrylate and polyethyl methacrylate, urea resin, and gum Arabic.

The dispersion medium 21 is a liquid for dispersing the white particles 27 and the black particles 26 in the micro capsule 20. Examples of the dispersion medium 21 include water, alcoholic solvent (such as methanol, ethanol, isopropanol, butanol, octanol, and methyl cellosolve), esters (such as ethyl acetate and butyl acetate), ketones (such as acetone, methylethyl ketone, and methyl isobutyl ketone), aliphatic hydrocarbons (such as pentane, hexane, and octane), alicyclic hydrocarbons (such as cyclohexane and methyl cyclohexane), aromatic hydrocarbons (such as benzene, toluene, and benzenes having a long-chain alkyl group (such as xylene, hexyl benzene, heptyl benzene, octyl benzene, nonyl benzene, decyl benzene, undecyl benzene, dodecyl benzene, tridecyl benzene, and tetradecyl benzene)), halogenated hydrocarbon (such as methylene chloride, chloroform, carbon tetrachloride, and 1,2-dichloroethane), carboxylate salt, and other oil substances. These materials may be used singly or as a mixture and may be mixed with surfactant and the like.

The white particles 27 are particles (polymer or colloid) formed of white pigments such as titanium dioxide, zinc flower, and antimony trioxide and are charged to, for example, negative polarity for use. The black particles 26 are particles (polymer or colloid) formed of black pigments such as aniline black and carbon black and are charged to, for example, positive polarity for use.

A charging control agent including particles of electrolyte, surfactant, metal soap, resin, rubber, oil, varnish, or compound, a dispersion solvent such as titanium coupling agent, aluminum coupling agent, and silane coupling agent, lubricant, and stabilizer may be added to the pigments as needed.

For example, red, green, and blue pigments may be used instead of the black particles 26 and the white particles 27. In this case, the display unit 5 can display red, green, and blue.

Figure 5A:
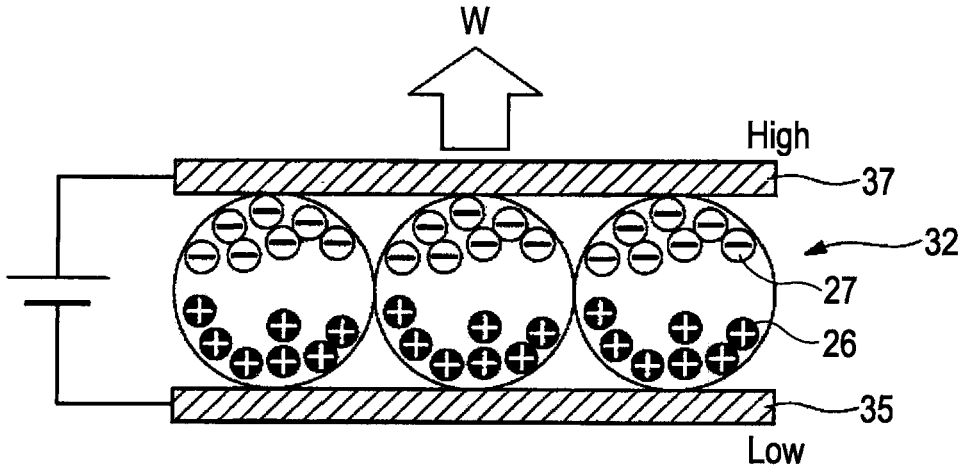
FIGS. 5A and 5B are diagrams illustrating an operation of electrophoretic elements.
Figure 5B:
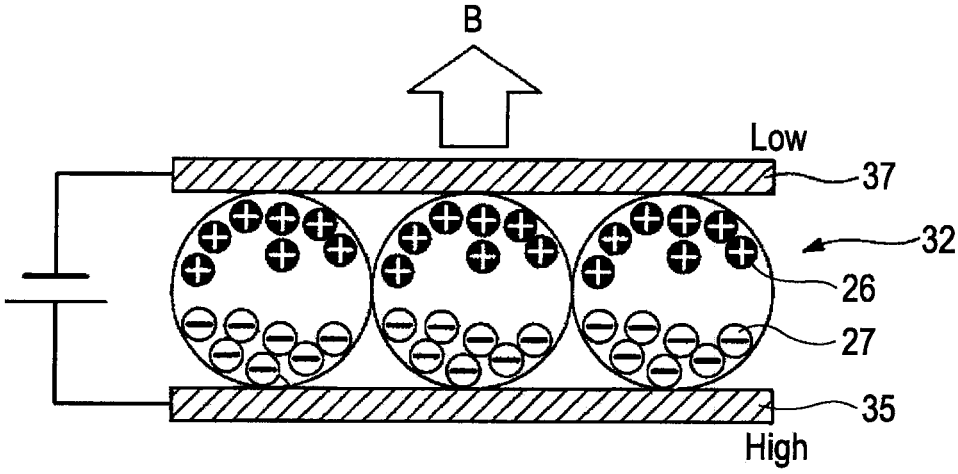

FIGS. 5A and 5B are diagrams illustrating an operation of the electrophoretic elements. FIG. 5A shows a state where the pixel 40 displays white and FIG. 5B shows a state where the pixel 40 displays black.

In the white display shown in FIG. 5A, the common electrode 37 is in the relatively high potential and the pixel electrode 35 is in the relatively low potential. Accordingly, the white particles 27 charged to negative are attracted to the common electrode 37 and the black particles 26 charged to positive are attracted to the pixel electrode 35. As a result, when the pixel is viewed from the common electrode 37 as the display surface, white (W) is recognized.

In the black display shown in FIG. 5B, the common electrode 37 is in the relative low potential and the pixel electrode 35 is in the relatively high potential. Accordingly, the black particles 26 charged to positive are attracted to the common electrode 37 and the white particles 27 charged to negative are attracted to the pixel electrode 35. As a result, when the pixel is viewed from the common electrode 37, black (B) is recognized.

In the electrophoretic display device 100, an image signal is stored as a potential in the latch circuit 70 by inputting the image signal to the data input terminal N1 of the latch circuit 70 through the driving TFT 41. The first control line 91 or the second control line 92 is connected to the pixel electrode 35 by the switch circuit 80 operating on the basis of the potentials of the data input terminal N1 and the data output terminal N2 of the latch circuit 70. Accordingly, a potential corresponding to the image signal is input to the pixel electrode 35 and the pixel 40 displays white or black on the basis of the potential difference between the pixel electrode 35 and the common electrode 37 as shown in FIGS. 5A and 5B.

Control Unit

Figure 6:
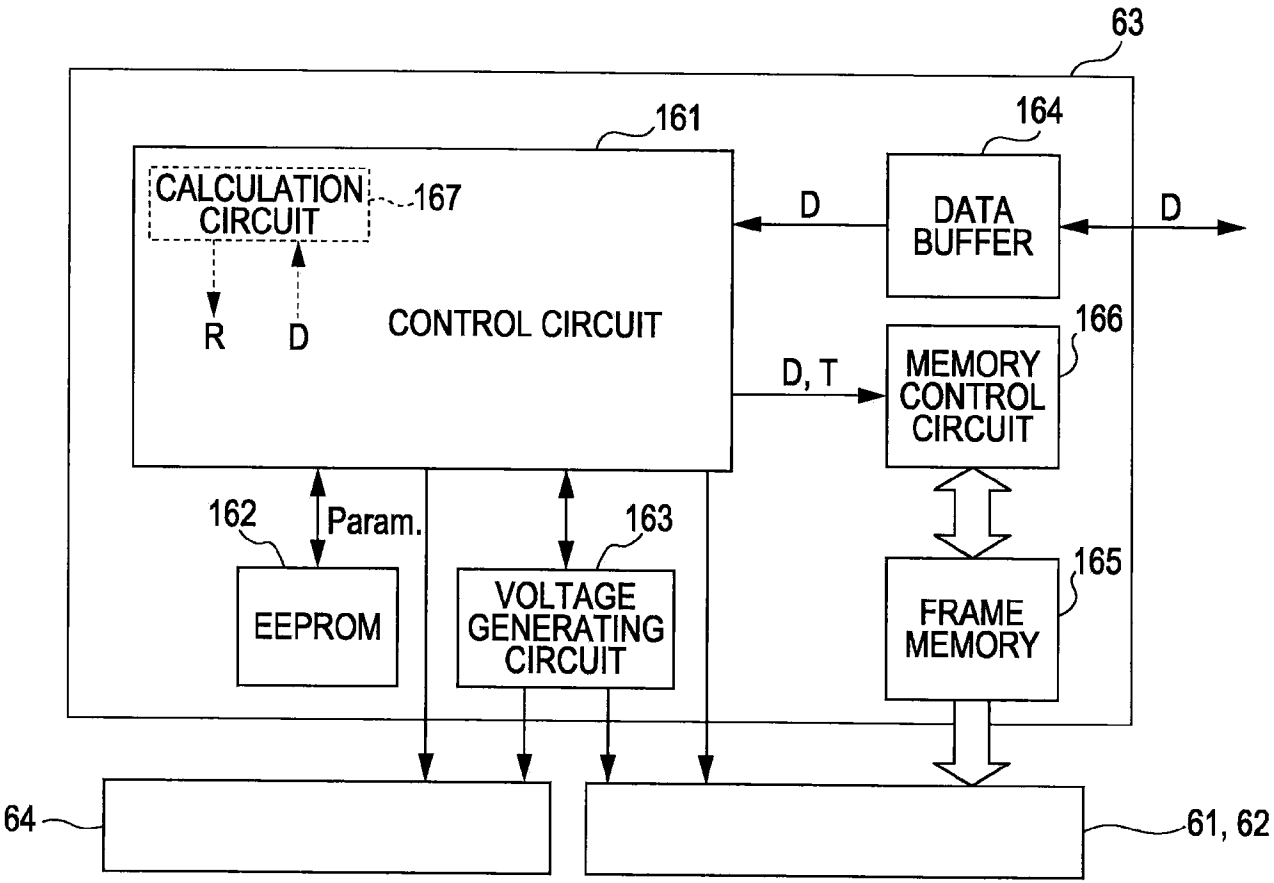
FIG. 6 is a block diagram illustrating the electrophoretic display device according to the embodiment of the invention.

FIG. 6 is a block diagram illustrating a configuration of the controller 63 of the electrophoretic display device 100.

The controller 63 includes a control circuit 161 as a CPU (Central Processing Unit), an EEPROM (Electrically-Erasable and Programmable Read-Only Memory) (memory unit) 162, a voltage generating circuit 163, a data buffer 164, a frame memory 165, and a memory control circuit 166.

The control circuit 161 generates control signals (timing pulses) such as a clock signal CLK, a horizontal synchronization signal Hsync, and vertical synchronization signal Vsync and supplies the generated control signals to the circuits disposed around the control circuit 161. In this embodiment, the control circuit 161 has a calculation circuit (calculation unit) 167.

The EEPROM 162 stores set values (mode set value or volume value) necessary for allowing the control circuit 161 to control operations of the circuits. For example, the EEPROM stores the set values of driving sequences of the operation modes as LUT (Look Up Table). The EEPROM 162 may store preset image data used to display an operation state of the electrophoretic display device.

The voltage generating circuit 163 serves to supply driving voltages to the scanning line driver circuit 61, the data line driving circuit 62, and the common power modulation circuit 64.

The data buffer 164 is an interface unit with an upper-level unit of the controller 63 and serves to hold image data D input from the upper-level unit and to transmit the image data D to the control circuit 161.

The frame memory 165 is a readable and writable memory having a readable and writable memory space corresponding to the arrangement of the pixels 40 of the display unit 5. The memory control circuit 166 develops the image data D supplied from the control circuit 161 to correspond to the pixel arrangement of the display unit 5 in accordance with the control signal and writes the developed image data in the frame memory 165. The frame memory 165 sequentially transmits a data group including the image data D as image signals to the data line driver circuit 62.

The data line driver circuit 62 latches the image signals transmitted from the frame memory 165 line by line on the basis of the control signal supplied from the control circuit 161. Then, the data line driver circuit supplies the latched image signals to the data lines 68 in synchronization with the operation of the scanning line driver circuit 61 sequentially selecting the scanning lines 66.

The calculation circuit 167 receives the image data D input to the control circuit 161 and outputs a parameter R which is a ratio of the pixel data of each gray scale in the image data D. In this embodiment, since the image data D includes binary pixel data ("1" and "0") of black and white, the calculation circuit 167 counts the number of pixel data "1" (black) and the number of pixel data "0" (white) included in the image data D and outputs the ratio of the pixel data "1" (or pixel data "0") with respect to the image data D as the parameter R.

The calculation circuit 167 may be mounted as a peripheral circuit of the control circuit 161 in the controller 63. When the image data D input from the upper-level unit includes the previously acquired parameter R, the calculation circuit 167 of the controller 63 has a function of extracting and outputting the parameter R from the image data D.

The image data D may include pixel data of three or more gray scale values. In this case, the calculation circuit 167 also the ratio of a specific gray scale (for example, pixel data "1") or the ratio of pixel data of each gray scale as a parameter.

Driving Method

Figure 7:
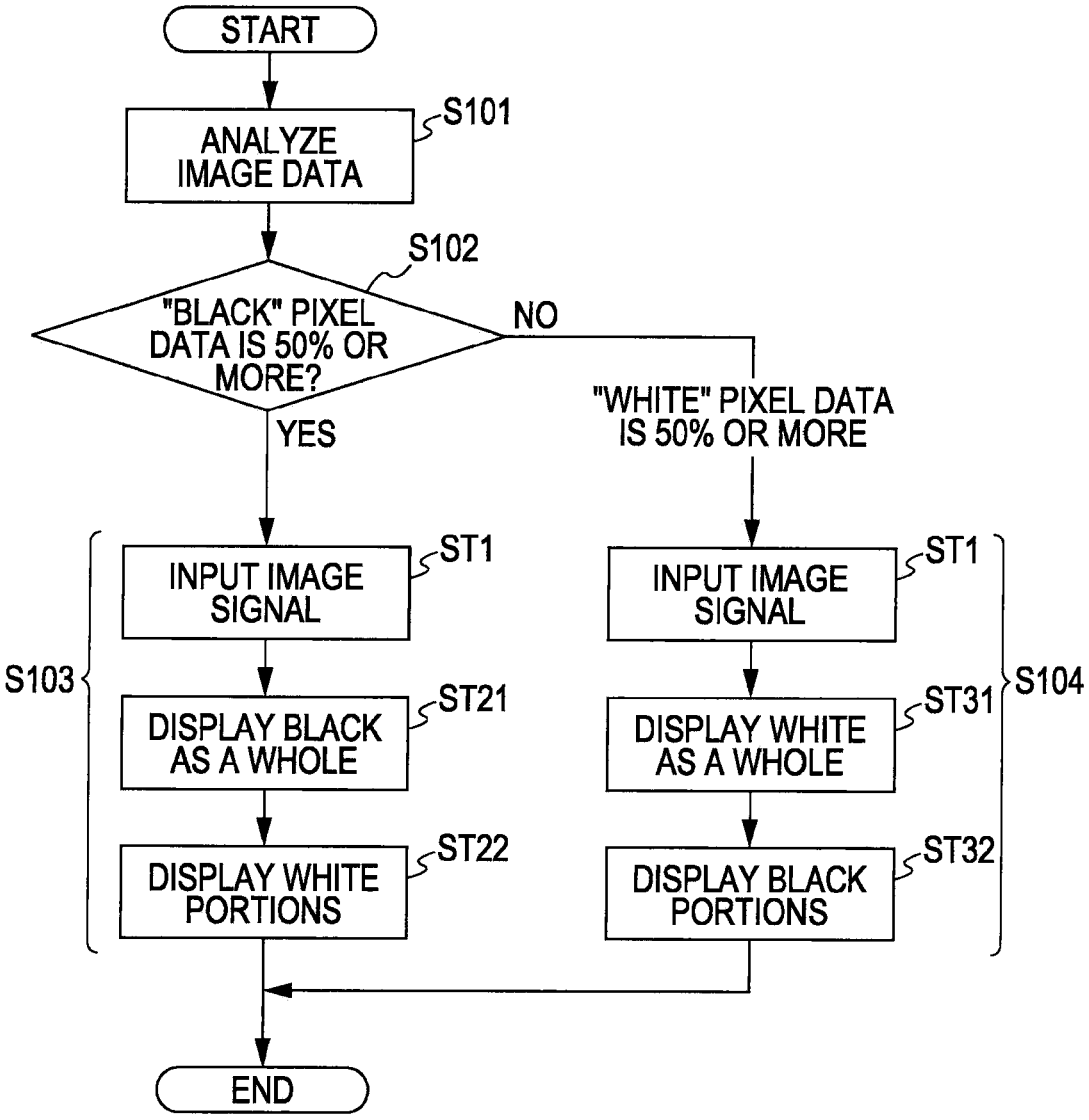
FIG. 7 is a flowchart illustrating a driving method according to the embodiment of the invention.

FIG. 7 is a flowchart illustrating a driving method of the electrophoretic display device having the above-mentioned configuration. As shown in FIG. 7, the driving method according to this embodiment includes an image data analyzing action S101, an operation mode determining action S102, and image display actions S103 and S104 exclusively selected on the basis of action S102.

In the actual driving process, the image data D of the display image is supplied to the control circuit 161 through the data buffer 164 before the image data analyzing action S101. The control circuit 161 transmits the image data D to the memory control circuit 166 and the memory control circuit 166 develops the image data D in the memory space of the frame memory 165. Accordingly, the image signals can be supplied from the frame memory 165 to the data line driver circuit 62.

First, in the image data analyzing action S101, the image data D is input to the calculation circuit 167 in the control circuit 161. The calculation circuit 167 counts the number of pixel data "1" (black) or pixel data "0" (white) in the input image data D. The calculation circuit calculates the ratio of pixel data "1" in the image data D (entire pixel data) and outputs the calculated ratio as the parameter R. In this embodiment, values of 0% to 100% are output as the parameter R.

When the parameter R is output from the calculation circuit 167, the operation mode determining action S102 is performed. In the operation mode determining action S102, the value of the parameter R is estimated by the control circuit 161. As a result, when the ratio of pixel data "1" (black) is 50% or more, the image display action S103 is performed. When the ratio of pixel data "1" (black) is less than 50% (that is, when the ratio of pixel data "0" (white) is 50% or more, the image display action S104 is performed.

Although it has been described in this embodiment that the ratio of pixel data "1" (black) is determined by the control circuit 161, the estimation target may be properly changed depending on the parameter R output from the calculation circuit 167. That is, the ratio of pixel data "0" in the image data D or the ratios of pixel data "1" and "0" in the image data D may be output as the parameter R. In this case, the estimation algorithm may be changed depending on the type of the parameter R.

The mode changing operation based on the determination result in the operation mode determining action S102 is performed by storing a series of actions performed in the image display action S103 and the image display action S104 in the EEPROM 162, properly reading the series of steps on the basis of the determination result, and changing the driving sequence related to the image display.

As described later in detail (see Table 1), the difference between the image display step S103 and the image display step S104 is only the driving type of the first and second control lines 91 and 92 and the common electrode line 55, which are all lines driven by the common power modulation circuit 64. Accordingly, the operation mode of the common power modulation circuit 64 may be switched by the input of a mode switching signal from the control circuit 161.

In the image display actions S103 and S104, the image display action of the display unit 5 is performed. That is, the scanning line driver circuit 61, the data line driver circuit 62, and the common power modulation circuit 64 are driven in accordance with the operation mode (driving sequence) selected in the operation mode determining action S102, thereby displaying an image on the display unit 5. The image display actions S103 and S104 will be described now in detail with reference to Table 1 and FIGS. 7 to 11. In Table 1, the driving sequences in the image display actions S103 and S104 and potential states of the lines in the respective periods of the driving sequences are shown.

TABLE 1

| | | | Potential state of line | | |
|---|---|---|---|---|---|
| | | Driving sequence | Vcom | S1 | S2 |
| S103 | ST1 | Input of image signal | Hi-Z | Hi-Z | Hi-Z |
| | ST21 | Entire black display | L | H | H |
| | ST22 | Partial white display | H | Hi-Z | L |
| S104 | ST1 | Input of image signal | Hi-Z | Hi-Z | Hi-Z |
| | ST31 | Entire white display | H | L | |
| | ST32 | Partial black display | L | H | Hi-Z |

The image display action S103 is a first operation mode in the electrophoretic display device 100. As shown in FIG. 7 and Table 1, the image display action S103 includes an image signal input period ST1 in which the image signals are input to the latch circuits 70 of the pixels 40, a first image display period ST21 in which all the pixels 40 of the display unit 5 are made to display black, and a second image display period ST22 in which a white image pattern is displayed on the display unit 5.

On the other hand, the image display action S104 is a second operation mode in the electrophoretic display device 100. The image display action S104 includes the image signal input period ST1, a first image display period ST31 in which all the pixels 40 of the display unit 5 are made to display white, and a second image display period ST32 in which a black image pattern is displayed on the display unit 5.

First Operation Mode (Action S103)

Figure 8:
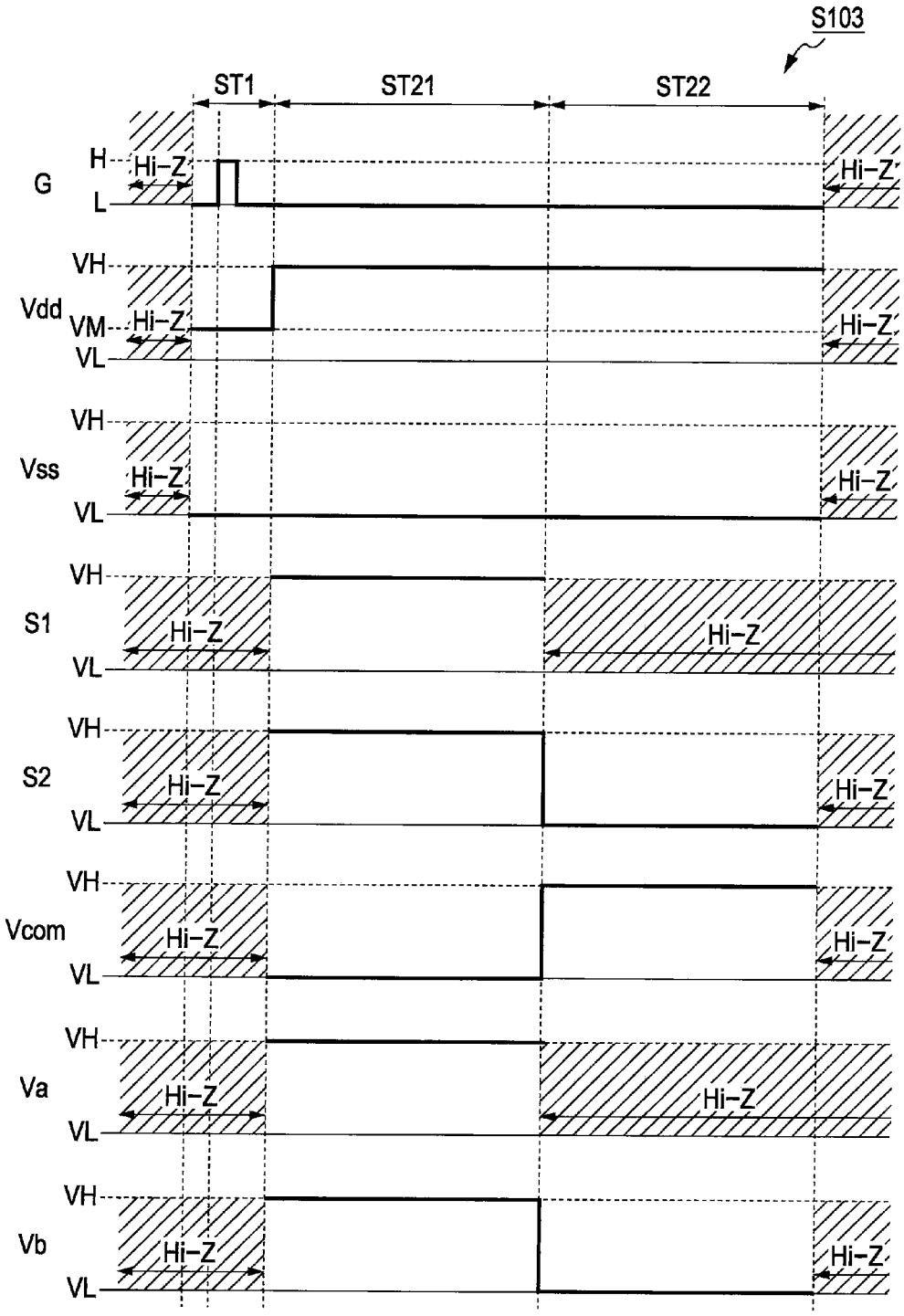
FIG. 8 is a timing diagram illustrating a first operation mode.

FIG. 8 is a timing diagram illustrating the image display action S103 as the first operation mode.

Figure 9A:
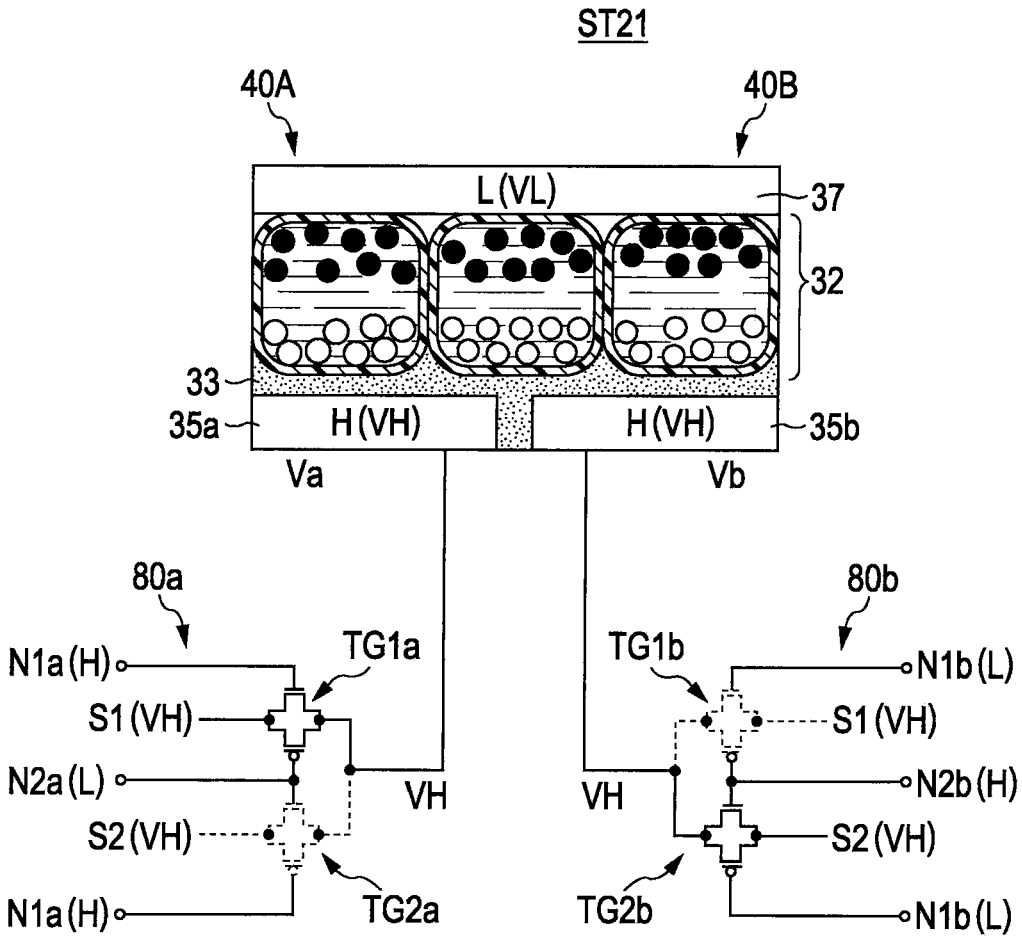
FIGS. 9A and 9B are diagrams illustrating states of adjacent pixels in the first operation mode.
Figure 9B:
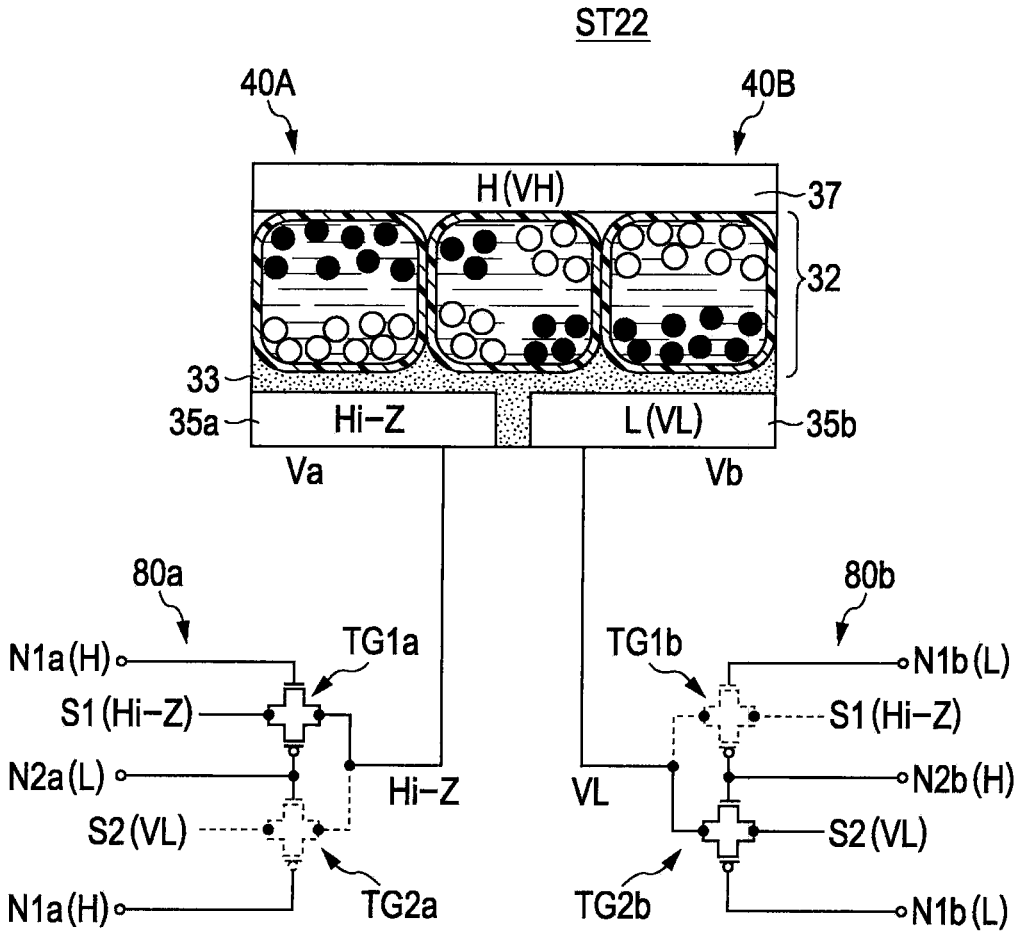

Operations of two pixels 40A and 40B adjacent to each other in the plural pixels 40 disposed in the display unit 5 will be described now as an example. FIGS. 9A and 9B are diagrams illustrating a potential relation between two adjacent pixels 40A and 40B in the first image display period ST21 and the second image display period ST22 shown in FIG. 8.

In FIGS. 8, 9A, and 9B, the suffixes "A", "B", "a", and "b" attached to reference numerals are used to clearly discriminate the two adjacent pixels 40 and the elements thereof.

In FIG. 8, the potential G of the scanning line 66, the potential Vdd of the high-potential power supply line 50, the potential Vss of the lower-potential power supply line 49, the potential S1 of the first control line 91, the potential S2 of the second control line 92, the potential Vcom of the common electrode 37, the potential Va of the pixel electrode 35*a*, and the potential Vb of the pixel electrode 35*b* are shown. In FIGS. 9A and 9B, the pixel electrodes 35*a* and 35*b* and the switching circuits 80*a* and 80*b* of the pixels 40A and 40B are shown.

As shown in Table 1 and FIGS. 8, 9A, and 9B, the scanning line 66 (an the data line 68), the high-potential power supply line 50, and the lower-potential power supply line 49 which are in a high impedance state (Hi-Z) electrically disconnected are electrically connected in the corresponding driving circuit in the image signal input period ST1 of the image display action S103. Specifically, the low-level potential (L) is input to the scanning line 66, the high-level potential (VM) for inputting the image signal is input to the high-potential power supply line 50, and a low-level potential (VL) is input to the low-potential power supply line 49.

Accordingly, the latch circuit 70 is turned on into a state where it can store the image signal input from the data line 68. At this time, the first control line 91, the second control line 92, and the common electrode 37 maintain the high impedance state.

Thereafter, an image signal is input to the latch circuit 70 of each pixel 40. Specifically, a high-level (H) pulse is input to the scanning line 66 and the driving TFT 41 connected to the scanning line 66 is turned on. Accordingly, the data line 68 and the latch circuit 70 are connected to each other and the image signal is input to the latch circuit 70. In the pixel 40A displaying black, the high-level potential (H) is input as the image signal. The latch circuit 70 stores the input image signal as a potential.

When the image signals are input to the pixels 40A and 40B, the first image display period ST21 is started. In the first image display period ST21, the potential Vdd of the high-potential power supply line 50 rises from the high-level potential VM for inputting the image signal to the high-level potential VH for displaying an image. The potential Vss of the low-potential power supply line 57 is maintained in the low level VL.

As shown in Table 1 and FIG. 8, the common electrode 37, the first control line 91, and the second control line 92 are electrically connected in the corresponding control circuit and are changed to a state where a signal can be input. Both of the first control line 91 and the second control line 92 are supplied with the high-level potential VH for displaying an image. The common electrode 37 is supplied with the low-level potential VL.

As shown in FIG. 9A, since the data input terminal N1*a* of the latch circuit 70 of the pixel 40A is in the high level (H) and the data output terminal N2*a* is in the low level (L), the first transmission gate TG1*a* in the switch circuit 80*a* of the pixel 40A is turned on and the potential S1 of the first control line 91 is input to the pixel electrode 35*a*.

On the other hand, since the data input terminal Nib of the latch circuit 70 of the pixel 40B is in the low level (L) and the data output terminal N2*b* is in the high level (H), the second transmission gate TG2*b* in the switch circuit 80*b* of the pixel 40B is turned on and the potential S2 of the second control line 92 is input to the pixel electrode 35*b*.

In this way, both of the pixel electrodes 35*a* and 35*b* have the high-level potential VH. The electrophoretic element 32 is driven by the potential difference between the common electrode 37 maintained in the low level potential VL and the pixel electrodes 35*a* and 35*b*. That is, as shown in FIG. 5B, the black particles 26 charged to positive are attracted to the common electrode 37 and the white particles 27 charged to negative are attracted to the pixel electrode 35*a*, whereby both the pixels 40A and 40B display black and thus the display unit 5 is in the entire black display state.

Thereafter, the second image display period ST22 is started.

In the second image display period ST22, as shown in Table 1 and FIG. 8, the first control line 91 is changed to a high-impedance state where it is electrically disconnected and the low-level potential VL is input to the second control line 92. The high-level potential VH is input to the common electrode 37.

Accordingly, as shown in FIG. 9B, the pixel electrode 35*a* electrically connected to the first control line 91 in the pixel 40A is changed to the high-impedance state (Hi-Z). Accordingly, the electrophoretic element 32 of the pixel 40A is not driven to maintain the black display state.

On the other hand, the potential S2 (low-level potential VL) of the second control line 92 is input to the pixel electrode 35*b* in the pixel 40B. The electrophoretic element 32 is driven by the potential difference between the common electrode 37 having the high-level potential VH and the pixel electrode 35*b*. Then, as shown in FIG. 5A, the white particles 27 charged to negative are attracted to the common electrode 37 and the black particles 26 charged to positive are attracted to the pixel electrode 35*a*, whereby the pixel 40B displays white. Accordingly, the pixel 40B in which the image signal (low level) corresponding to pixel data "0" (white) is stored in the latch circuit 70 thereof selectively displays white, thereby forming a black and white image on the display unit 5.

The image based on the image data D can be displayed by the display unit 5 by the above-mentioned series of operations in the first image display period ST21 and the second image display period ST22.

After the image display action, as shown in FIG. 8, the first control line 91, the second control line 92, and the common electrode 37 are all changed to the high-impedance state. Accordingly, the pixel electrodes 35*a* and 35*b* connected to the first and second control lines 91 and 92 are changed to the high-impedance state and thus the electrophoretic element 32 is also electrically isolated. Therefore, it is possible to maintain an image without consuming power.

The leak between pixels in the first image display period ST21 and the second image display period ST22 will be described now.

First, in the first image display period ST21, as shown in FIG. 9A, the pixel electrode 35*a* of the pixel 40A has the high-level potential VH and the pixel electrode 35*b* of the pixel 40B has the high-level potential VH.

Accordingly, since there is no potential difference between the adjacent pixel electrodes 35*a* and 35*b*, the leak between pixels does not occur.

Then, in the second image display period ST22, since the pixel electrode 35*b* of the pixel 40B has the low-level potential VL but the pixel electrode 35*a* of the pixel 40A is in the high-impedance state, the leak path is broken. Accordingly, the leak between pixels does not occur in the second image display period ST22.

Accordingly, in the image display action S103, it is possible to display an image based on the image data on the display unit 5 without causing the leak between pixels.

Second Operation Mode (Action S104)

Figure 10:
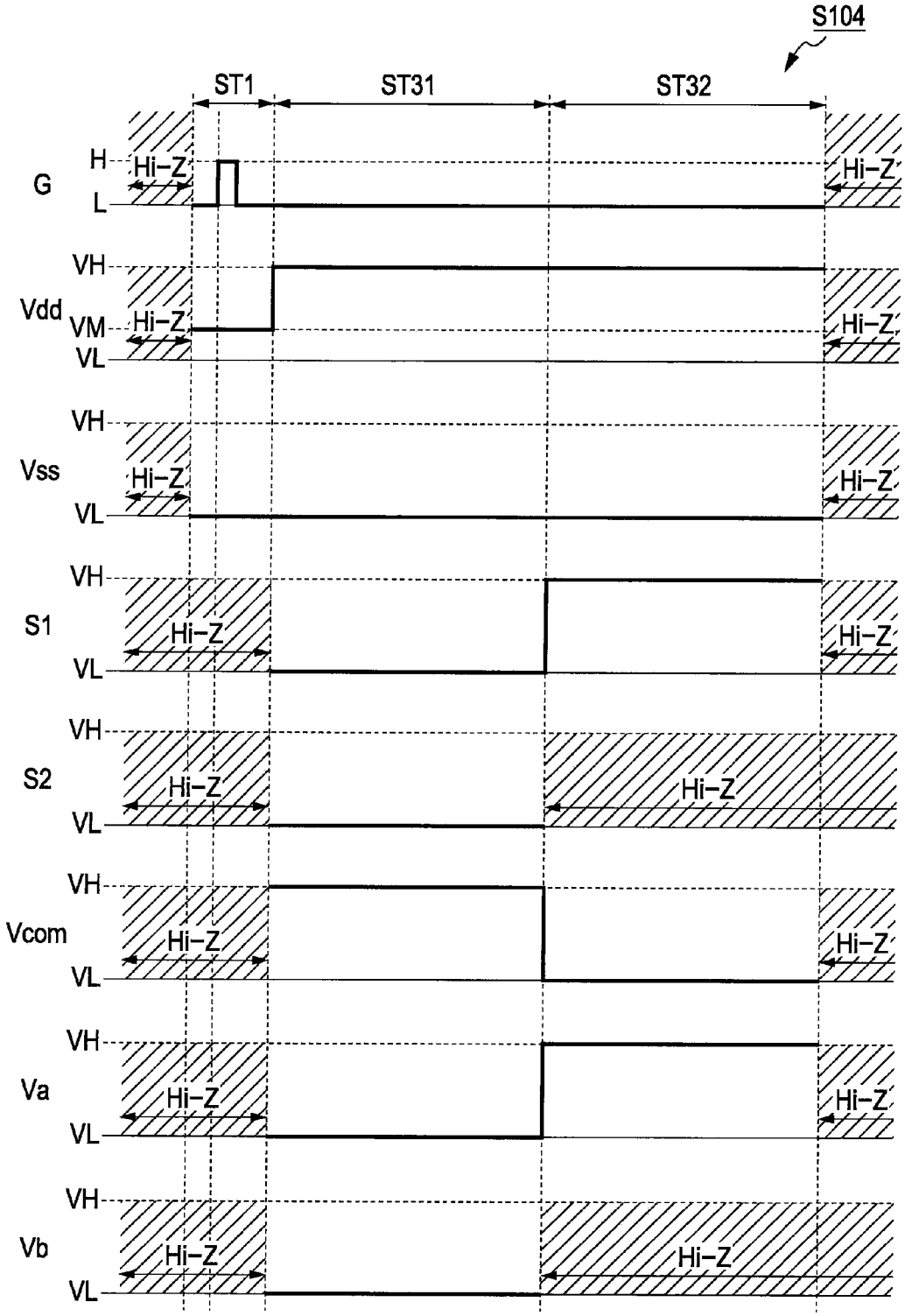
FIG. 10 is a timing diagram illustrating a second operation mode.
Figure 11A:
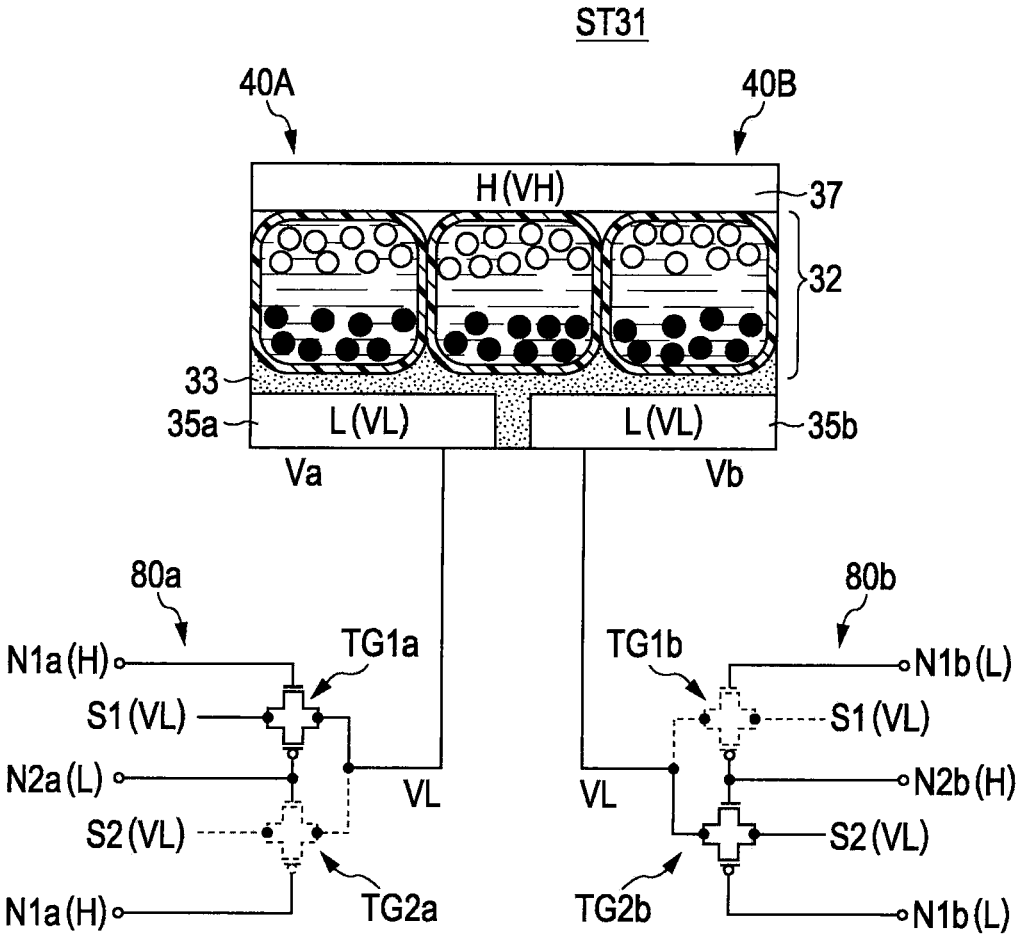
FIGS. 11A and 11B are diagrams illustrating states of adjacent pixels in the second operation mode.
Figure 11B:
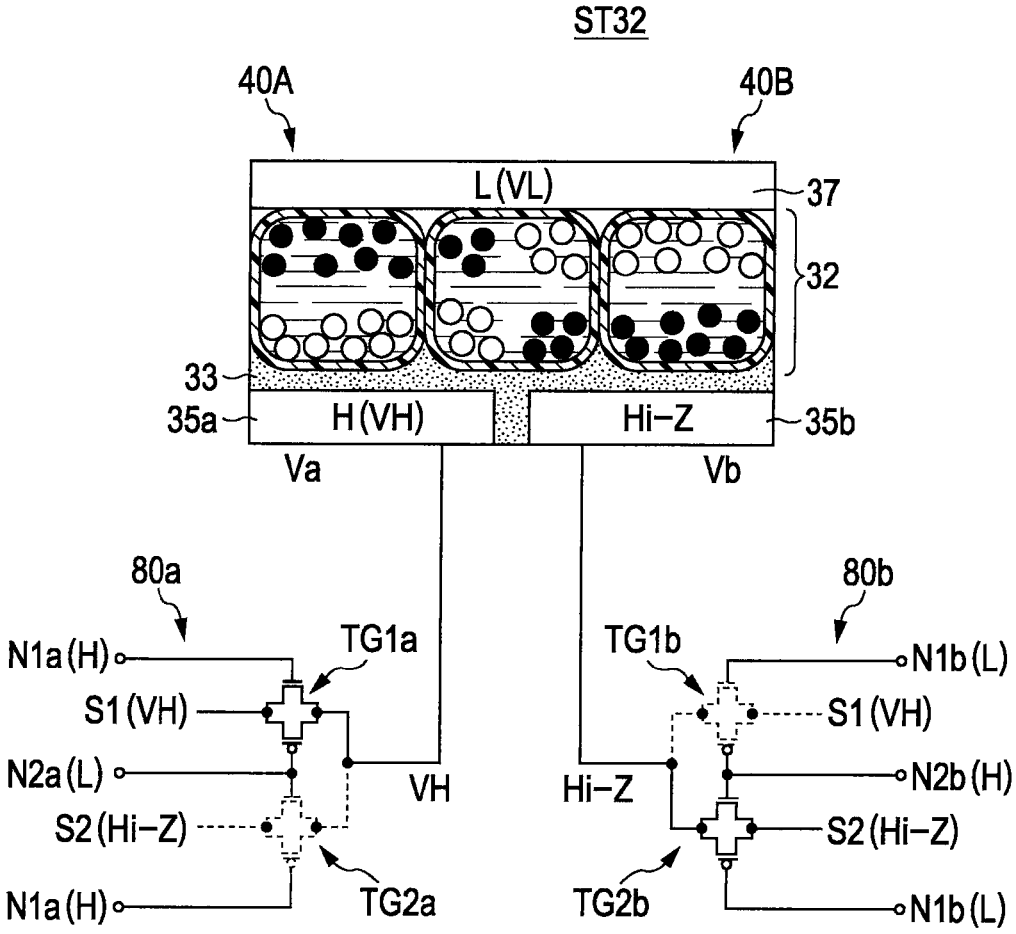

FIG. 10 is a timing diagram illustrating the image display action S104 as the second operation mode. FIGS. 11A and 11B are diagrams illustrating a potential relation between two adjacent pixels 40A and 40B in the first image display period ST31 and the second image display period ST32 shown in FIG. 10. FIG. 10 corresponds to FIG. 8 illustrating the first operation mode (action S103) and FIGS. 11A and 11B correspond to FIGS. 9A and 9B.

The second operation mode is different from the first operation mode, only in the color displayed in the first image display period and the color displayed in the second image display period. Accordingly, the description of the configurations and operations common to the first operation mode will be properly omitted.

As shown in Table 1 and FIGS. 10, 11A, and 11B, the image signals are input to the latch circuits 70 of the pixels 40A and 40B in the image signal input period ST1 of the image display action S104, similarly to the first operation mode (action S103).

Then, in the first image display period ST31, the potential Vdd of the high-potential power supply line 50 is raised to the high-level potential VH for displaying an image and the potential Vss of the low-potential power supply line 49 is changed to the low-level potential VL for displaying an image. The first control line 91, the second control line 92, and the common electrode 37 are electrically connected in the corresponding driving circuit into a state where a signal can be input.

The low-level potential VL is input to the first control line 91 and the second control line 92 and the high-level potential VH is input to the common electrode 37. Accordingly, in the pixel 40A, the low-level potential VL is input to the pixel electrode 35*a* through the first transmission gate TG1*a*. In the pixel 40B, the low-level potential VL is input to the pixel electrode 35*b* through the second transmission gate TG2*b*. As a result, the electrophoretic element 32 is driven by the potential difference between the common electrode 37 having the high-level potential VH and the pixel electrodes 35*a* and 35*b* having the low-level potential VL, whereby both of the pixels 40A and 40B display white. Accordingly, the display unit 5 is in the entire white display state.

In the second image display period ST32, the second control line 92 is changed to the high-impedance state and the high-level potential VH is input to the first control line 91. The low level potential VL is input to the common electrode 37.

Then, in the pixel 40A, the high-level potential VH is input to the pixel electrode 35*a* through the first transmission gate TG1*a*, whereby the pixel 40A displays black by the potential difference from the common electrode 37. On the other hand, in the pixel 40B, the pixel electrode 35*b* is in the high-impedance state, whereby the white display is maintained.

Accordingly, the pixel 40A in which the image signal (high level) corresponding to pixel data "1" (black) is stored in the latch circuit 70 selectively displays black and an image based on the image data is displayed on the display unit 5.

Thereafter, similarly to the first operation mode, the lines are changed to the high-impedance state, thereby maintaining the image on the display unit 5 without consuming power.

The leak between pixels in the first image display period ST31 and the second image display period ST32 will be described now.

First, in the first image display period ST31, as shown in FIG. 11A, the pixel electrode 35*a* of the pixel 40A has the low-level potential VL and the pixel electrode 35*b* of the pixel 40B has the low-level potential VL. Accordingly, since there is no potential difference between the adjacent pixel electrodes 35*a* and 35*b*, the leak between pixels does not occur.

Then, in the second image display period ST32, since the pixel electrode 35*a* of the pixel 40A has the high-level potential VH but the pixel electrode 35*b* of the pixel 40B is in the high-impedance state, the leak path is broken by the pixel electrode 35*b*. Accordingly, the leak between pixels does not occur in the second image display period ST32.

Therefore, in the image display action S104, it is possible to display an image based on the image data on the display unit 5 without causing the leak between pixels.

As described above in detail, in the driving method according to this embodiment, the entire surface of the display unit 5 displays black in the first image display period ST21 of the image display action S103 and then displays a white image pattern in the second image display period ST22. The entire surface of the display unit 5 displays white in the first image display period ST31 of the image display action S104 and then displays a black image pattern in the second image display period ST32.

In the first image display periods ST21 and ST31, all the pixel electrodes 35 are set to the same potential, thereby preventing the leak between pixels. In the second image display periods ST22 and ST32, it is possible to prevent the leak between pixels by driving only the pixel 40 displaying black or white and changing the pixel electrodes 35 of the pixels 40 not driven to the high-impedance state.

Accordingly, in this embodiment, the leak between pixels does not occur in any period, and an image based on the image data D can be displayed on the display unit 5 while preventing the increase in power consumption due to the leak.

In this embodiment, the parameter R which is the ratio of pixel data "1" (black) in the image data D displayed on the display unit 5 is calculated in advance and the first or second operation mode is selected on the basis of the estimation result on the parameter R. That is, when the number of pixels 40 displaying black is great, the image display action S103 of first displaying black as a whole is performed. When the number of pixels 40 displaying white is great, the image display action S104 of first displaying white as a whole is performed. By using such a driving method, the number of pixels 40 (the number of pixels 40 driven twice) driven in the second image periods ST22 and ST32 is reduced, thereby suppressing the power consumption of the display operation.

In the driving method according to this embodiment, the potential of the common electrode 37 is kept constant in the first image display period ST21 (ST31) and the second image display period ST22 (ST32), but a driving method of inputting pulse-like signals periodically repeating the high-level potential VH and the low-level potential VL to the common electrode 37 in the periods may be employed. This driving method is called "common swing driving method" in this application. In the common swing driving method, a pulse repeating the high-level potential VH and the low-level potential VL is applied to the common electrode 37 for at least one period in the image display periods (ST21, ST22, ST31, and ST32).

The frequency and period of the common swing driving are preferably determined on the basis of the specification and characteristics of the electrophoretic elements 32.

In the driving method according to this embodiment, an image erasing period in which the image displayed on the display unit 5 is erased may be provided. The image erasing period is preferably provided before the first image display periods ST21 and ST31. For example, the image erasing period may be provided between the image signal input period ST1 and the first image display periods ST21 and ST31. Alternatively, the image erasing period may be provided as the same period as the image signal input period ST1 or just before the image signal input period ST1.

Specifically, in the image erasing period, for example, the operation of allowing the entire surface of the display unit 5 to display the same gray scale (white or black) is performed once or plural times. In this case, when the image display action S103 of displaying black as a whole in the first image display period ST21 is selected, a period in which white is displayed as a whole is preferably provided as the image erasing period just before the first image display period ST21. On the other hand, when the image display action S104 is selected, a period in which black is displayed as a whole is preferably provided as the image erasing period just before the first image display period ST31.

By using such a driving method, when the first image display periods ST21 and ST31 is started after the image erasing period, it is possible to effectively agitate the black particles 26 and the white particles 27 of the electrophoretic elements 32, thereby obtaining the high-quality display without any afterimage.

In the driving method according to this embodiment, when the second image display period ST22 is started from the first image display period ST21, the operation of setting the first control line 91 to the high-impedance state is preferably performed earlier than the operation of inputting the low-level potential VL to the second control line 92. When the second image display period ST32 is started after the first image display period ST31, the operation of setting the second control line 92 to the high-impedance state is preferably performed earlier than the operation of inputting the high-level potential VH to the first control line 91.

When a potential is input to one of the first and second control lines 91 and 92 before the other is changed to the high-impedance state, the potential difference is generated between the adjacent pixel electrodes 35*a* and 35*b* and the pixel electrodes 35*a* and 35*b* are connected to the first or second control line 91 and 92. Accordingly, in this case, the leak between pixels occurs to enhance the power consumption.

Electronic Apparatus

Figure 12:
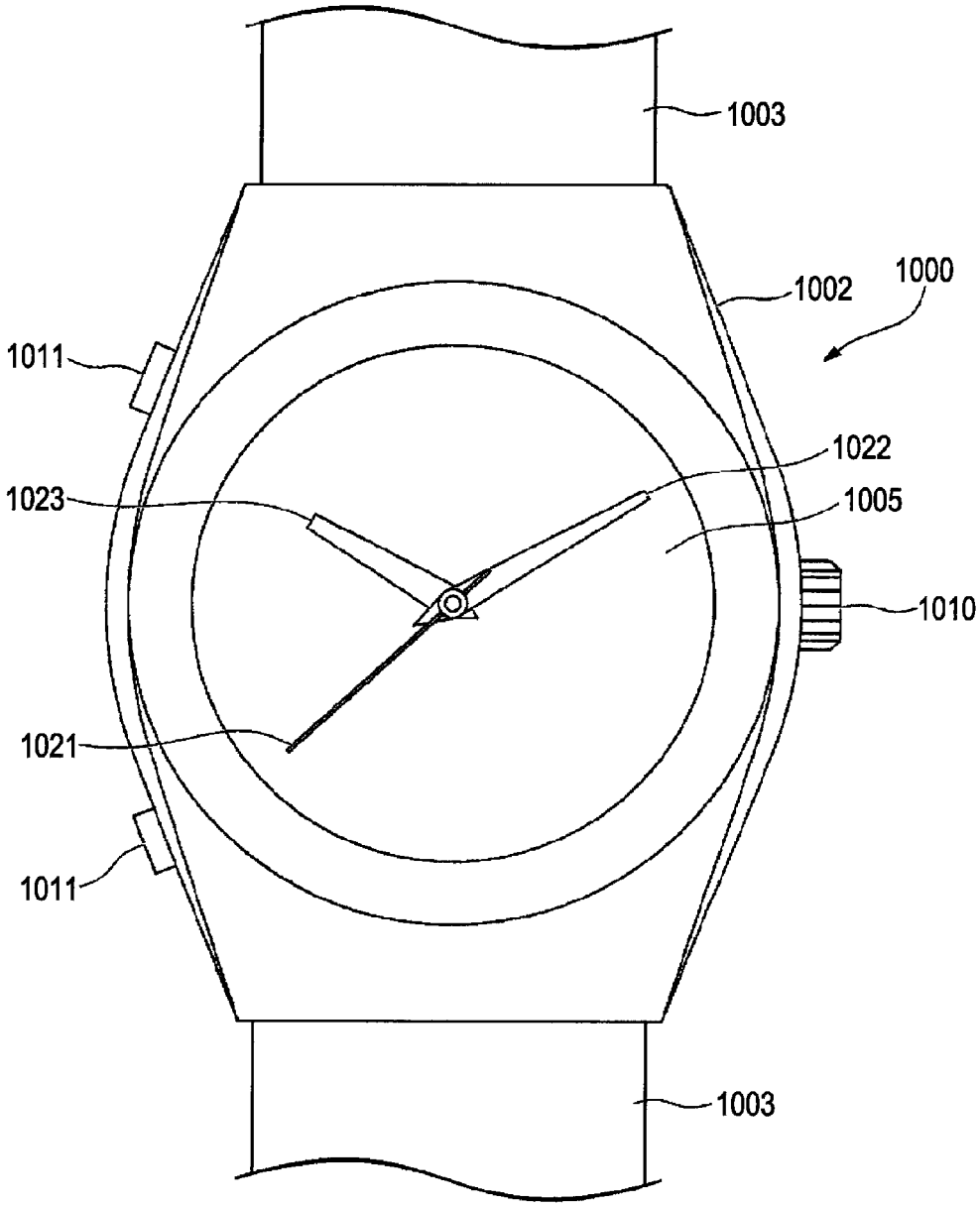
FIG. 12 is a diagram illustrating a wrist watch as an example of an electronic apparatus.

An electronic apparatus employing the electrophoretic display device 100 according to this embodiment will be described now. FIG. 12 is a front view of a wrist watch 1000. The wrist watch 1000 includes a watch case 1002 and a pair of bands 1003 coupled to the watch case 1002.

The front surface of the watch case 1002 is provided with a display unit 1005 employing the electrophoretic display device 100 according to the embodiment, a second hand 1021, a minute hand 1022, and an hour hand 1023. The side surface of the watch case 1002 is provided with a winder 1010 and an operation button 1011. The winder 1010 is connected to a winding stem (not shown) disposed in the case and can be pressed, pulled, and freely rotated by multiple steps (for example, two steps) along with the winding stem. An image as a background, a string such as date and time, or a second hand, a minute hand, and an hour hand can be displayed on the display unit 1005.

Figure 13:
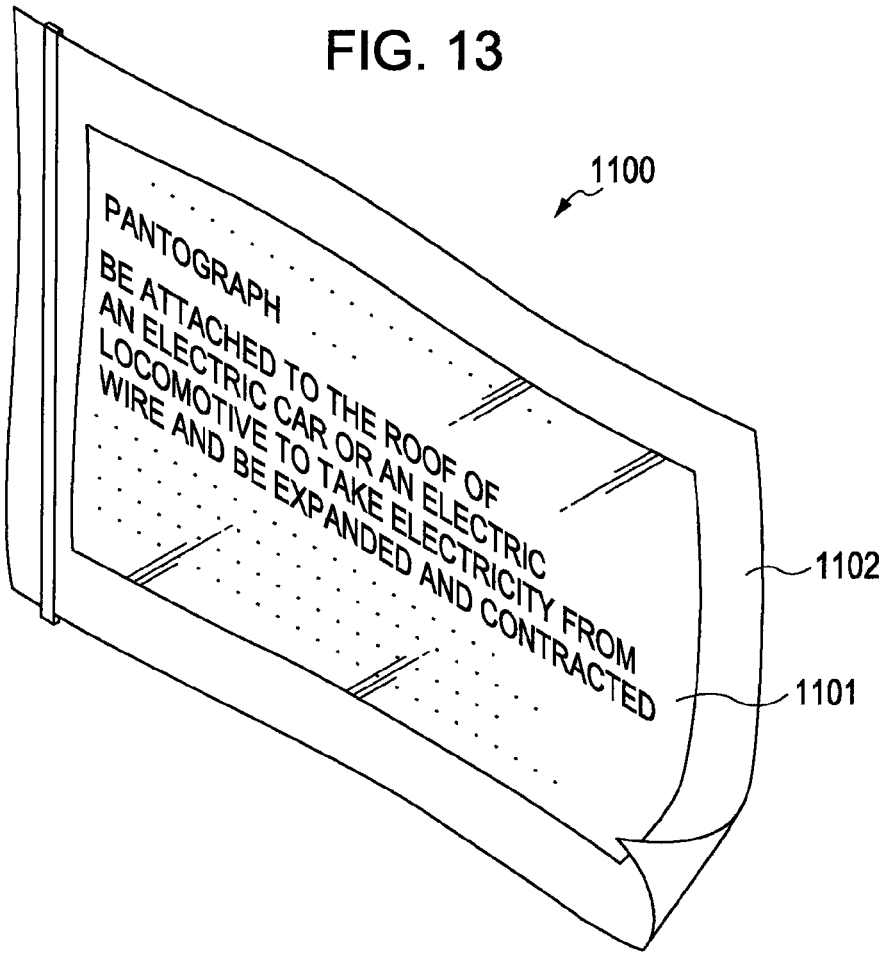
FIG. 13 is a diagram illustrating an electronic paper as an example of an electronic apparatus.

FIG. 13 is a perspective view illustrating a configuration of an electronic paper 1100. The electronic paper 1100 includes the electrophoretic display device 100 according to this embodiment as a display area 1101. The electronic paper 1100 is flexible and includes a main body 1102 formed of a rewritable sheet having texture like paper and flexibility.

Figure 14:
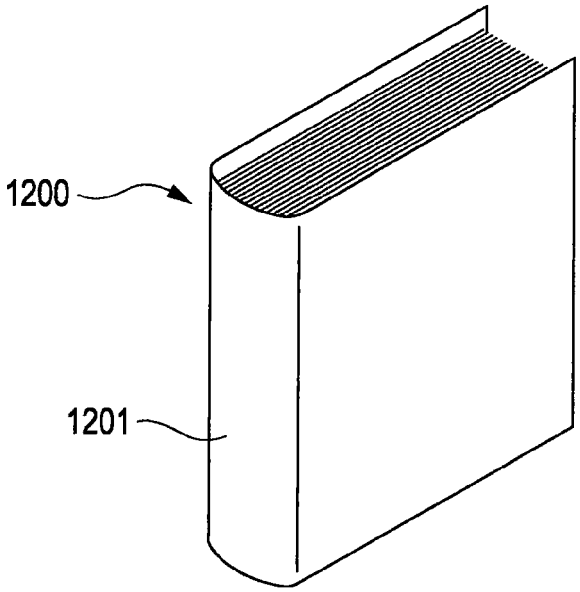
FIG. 14 is a diagram illustrating an electronic note as an example of an electronic apparatus.
Figure 15:
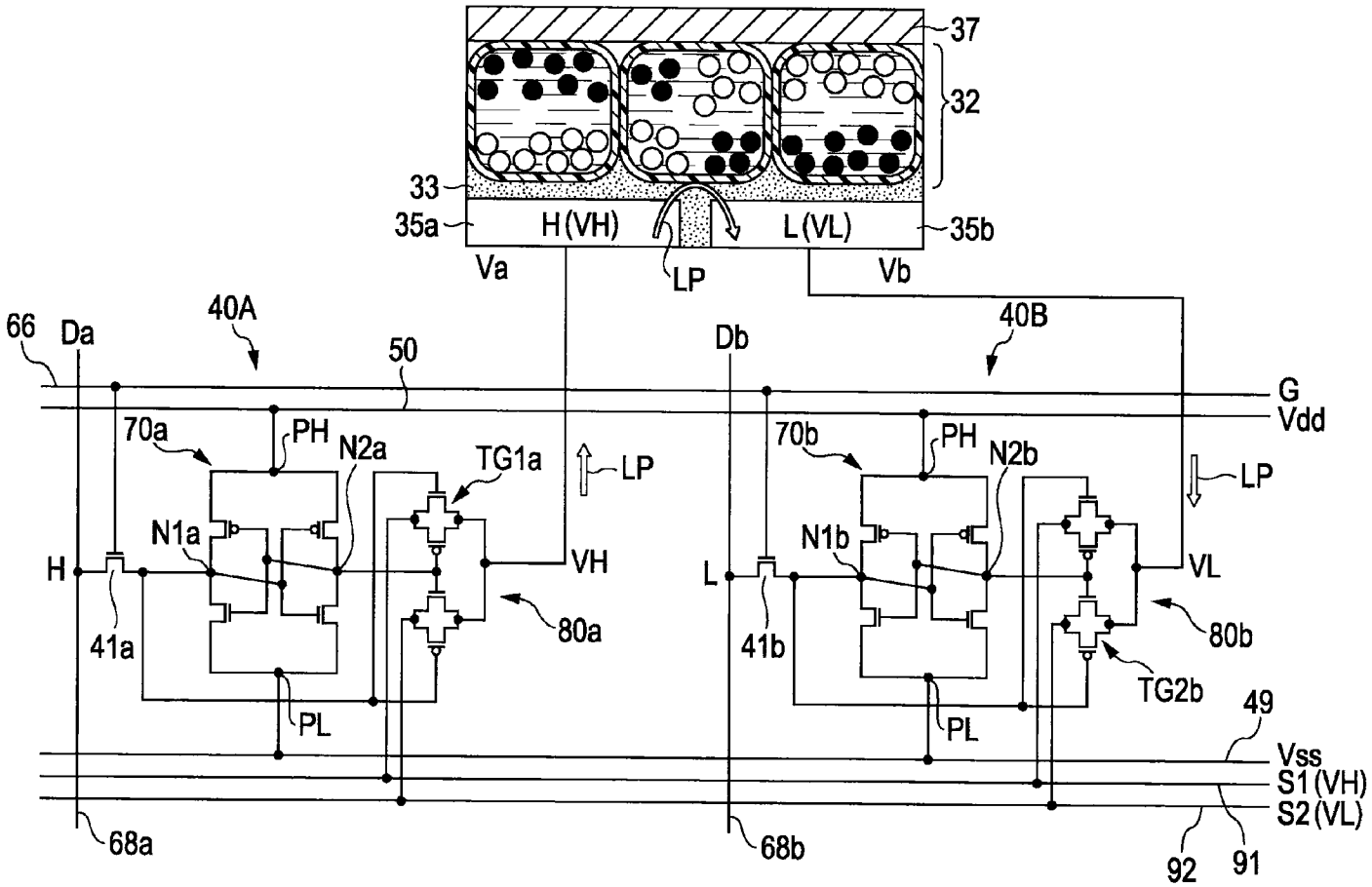
FIG. 15 is a diagram illustrating leak current in the electrophoretic display device.

FIG. 14 is a perspective view illustrating a configuration of an electronic note 1200. The electronic note 1200 has a configuration in which plural sheets of electronic papers 1100 shown in FIG. 13 are bound and inserted into a cover 1201. The cover 1201 includes a display data input unit for inputting display data supplied from an external device. Accordingly, the display details can be changed or updated on the basis of the display data with the electronic paper bound.

Since the wrist watch 1000, the electronic paper 1100, and the electronic note 1200 employ the electrophoretic display device 100 according to the invention as the display unit, they are electronic apparatuses having a display unit excellent in power save.

The electronic apparatuses shown in FIGS. 12 to 14 are intended to exemplify the electronic apparatus according to the invention, but are not intended to limit the technical scope of the invention. For example, the electrophoretic display device according to the invention can be suitably used for display units of electronic apparatuses such as a mobile phone and a portable audio apparatus.

The entire disclosure of Japanese Patent Application No. 2008-016170, filed Jan. 28, 2008 is expressly incorporated by reference herein.

What is claimed is:

1. A driving method of an electrophoretic display device, comprising:

the electrophoretic display device comprises a display unit including a plurality of pixels in which electrophoretic elements including electrophoretic particles are interposed between a pair of substrates, and the display unit displays an image based on image data that is configured with first and second gray scales;

each pixel of the plurality of pixels including a pixel electrode, a pixel switching element, a memory circuit connected between the pixel electrode and the pixel switching element, and a switch circuit connected between the pixel electrode and the memory circuit; and first and second control lines connected to the switch circuit, wherein when a first ratio of first pixel data corresponding to the first gray scale is 50% or more of the image data, a first three-step image display driving action is performed to display the image on the display unit as follows:

a first pixel data signal input step in which the image data is input as a first image signal to the memory circuit of each pixel;

a first image display step for the first pixel data in which all the pixels are set in the first gray scale by inputting first control signals having a first same potential to the first and second control lines so that an entire area of the display unit is in the first gray scale; and a second image display step for the first pixel data in which a first portion of the image, which corresponds to the second gray scale that is different from the first gray scale, is displayed at the display unit by inputting a first potential to one control line of the first and second control lines connected to the pixel electrode of the pixel to which the first image signal corresponding to the second gray scale is input, and electrically disconnecting the other control line so that the display unit displays the image in the first and second pray scales.

2. The driving method according to claim 1, wherein when a second ratio of second pixel data corresponding to the second gray scale is 50% or more of the image data, a second three-step image display driving action is performed to display the image on the display unit as follows:

a second pixel data signal input step in which the image data is input as a second image signal to the memory circuit of each pixel;

a third image display step for the second pixel data in which all the pixels are set in the second gray scale by inputting second control signals having a second same potential to the first and second control lines so that the entire area of the display unit is in the second gray scale, and a fourth image display step for the second pixel data in which a second portion of the image, which corresponds to the first gray scale, is displayed at the display unit by inputting a second potential to one control line of the first and second control lines connected to the pixel electrode of the pixel to which the second image signal corresponding to the first gray scale is input, and electrically disconnecting the other control line so that the display unit displays the image in the first and second gray scales.

3. The driving method according to claim 1, wherein an additional step in which all the pixels are set in the second gray scale by inputting second control signals having a second same potential to the first and second control lines is provided before the first image display step is performed so that the entire area of the display unit is in the second gray scale.

4. The driving method according to claim 1, wherein in the first pixel data signal input step, the first and second control lines and an electrode opposite to the pixel electrode through the electrophoretic elements are all electrically disconnected.

5. The driving method according to claim 1, wherein when the first image display step proceeds to the second image display step, an inputting operation for inputting the first potential to the one control line of the first and second control lines is performed later than a disconnecting operation for electrically disconnecting the other control line.

6. An electrophoretic display device, comprising:

a display unit including a plurality of pixels in which electrophoretic elements including electrophoretic particles are interposed between a pair of substrates, and the display unit displays an image based on image data that is configured with first and second gray scales;

each pixel of the plurality of pixels including a pixel electrode, a pixel switching element, a memory circuit connected between the pixel electrode and the pixel switching element, and a switch circuit connected between the pixel electrode and the memory;

first and second control lines connected to the switch circuit, and a control unit that controls driving of the plurality of pixels, the control unit controls first, second and third states of the plurality of pixels, and the control unit includes a calculation unit calculating a ratio of pixel data corresponding to either one of the first and second gray scales, wherein in the first state, the memory circuit of each pixel has the image data, in the second state, all the pixels are set in the first gray scale so that an entire area of the display unit is in the first gray scale, in the third state, a first portion of the image, which corresponds to the second gray scale that is different from the first gray scale, is displayed by the display unit so that the display unit displays the image in the first and second gray scales, and the control unit performs the first, second and third states when the ratio of the pixel data corresponding to the first gray scale is 50% or more of the image data as a first calculation result of the calculation unit.

7. The electrophoretic display device according to claim 6, the control unit further controls fourth and fifth states of the plurality of pixels, wherein in the fourth state, all the pixels are set in the second gray scale so that the entire area of the display unit is in the second gray scale, in the fifth state, a second portion of the image, which corresponds to the first gray scale, is displayed by the display unit so that the display unit displays the image in the first and second gray scales, and the control unit performs the first, fourth and fifth states when the ratio of the pixel data corresponding to the second gray scale is 50% or more of the image data as a second calculation result of the calculation unit.

8. An electronic apparatus comprising the electrophoretic display device according to claim 6.

* * * * *